US005732188A

United States Patent [19]

Moriya et al.

[11] Patent Number: 5,732,188

[45] Date of Patent: Mar. 24, 1998

[54] METHOD FOR THE MODIFICATION OF LPC COEFFICIENTS OF ACOUSTIC SIGNALS

[75] Inventors: Takehiro Moriya, Tokorozawa; Kazunori Mano, Tokyo; Satoshi Miki, Tokorozawa; Hitoshi Ohmura, Higashimurayama; Shigeaki Sasaki, Tachikawa; Naoki Iwakami, Yokohama, all of Japan

[73] Assignee: Nippon Telegraph and Telephone Corp., Tokyo, Japan

[21] Appl. No.: 612,797

[22] Filed: Mar. 11, 1996

[30] Foreign Application Priority Data

Mar. 10, 1995 [JP] Japan ..... 7-051174

[51] Int. Cl.[6] ..... G10L 9/04

[52] U.S. Cl. ..... 395/2.28; 395/2.29; 395/2.71

[58] Field of Search ..... 395/2.28, 2.29, 395/2.39, 2.67, 2.71, 2.32, 2.12, 2.13, 2.73, 2.78, 2.25, 2.26

[56] References Cited

U.S. PATENT DOCUMENTS 4,811,376 3/1989 Davis et al. ..... 379/57

FOREIGN PATENT DOCUMENTS

0562777A1 9/1993 European Pat. Off. .

*Primary Examiner*—Allen R. MacDonald
*Assistant Examiner*—Alphonso A. Collins
*Attorney, Agent, or Firm*—Pollock, Vande Sande & Priddy

[57] ABSTRACT

In a CELP coding scheme, p-order LPC coefficients of an input signal are transformed into n-order LPC cepctrum coefficients $c_j$ ($S_2$), which are modified into n-order modified LPC cepstrum coefficients $c_j'$ ($S_3$). Log power spectral envelopes of the input signal and a masking function suited thereto are calculated (FIGS. 3B, C), then they are subjected to inverse Fourier transform to obtain n-order LPC cepstrum coefficients, respectively, (FIGS. 3D, E), then the relationship between corresponding orders of the LPC cepstrum coefficients is calculated, and the modification in step $S_3$ is carried out on the basis of the relationship. The modified coefficients $c_j$ are inversely transformed by the method of least squares into m-order LPC coefficients for use as filter coefficients of a perceptual weighting filter. This concept is applicable to a postfilter as well.

15 Claims, 12 Drawing Sheets

FIG. 2
A PRIOR ART
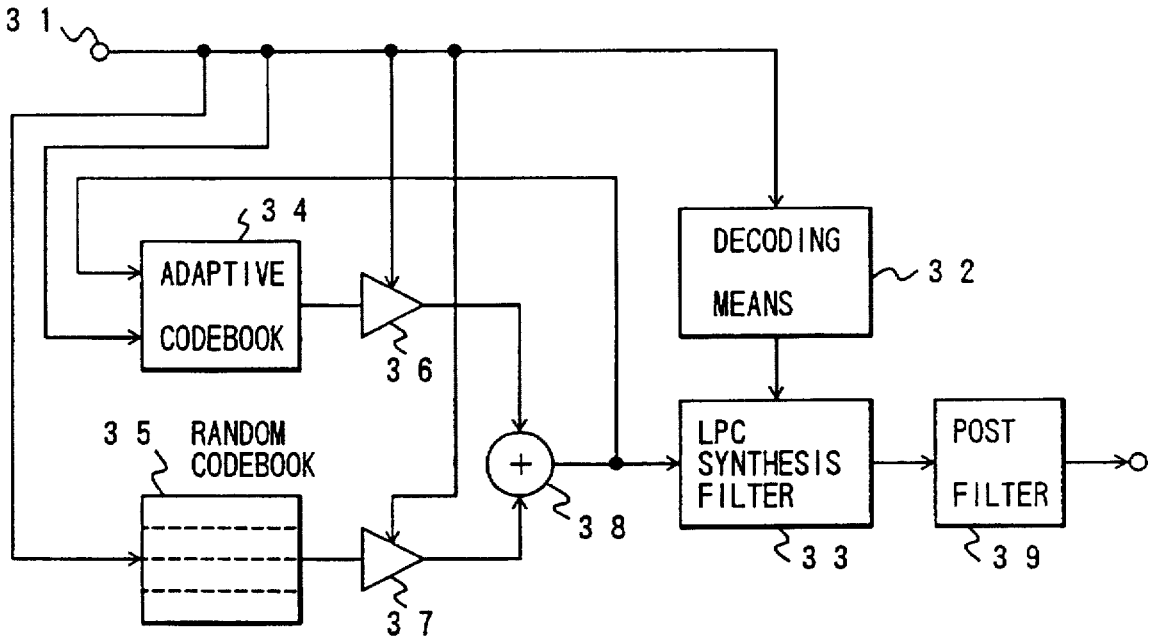
B PRIOR ART
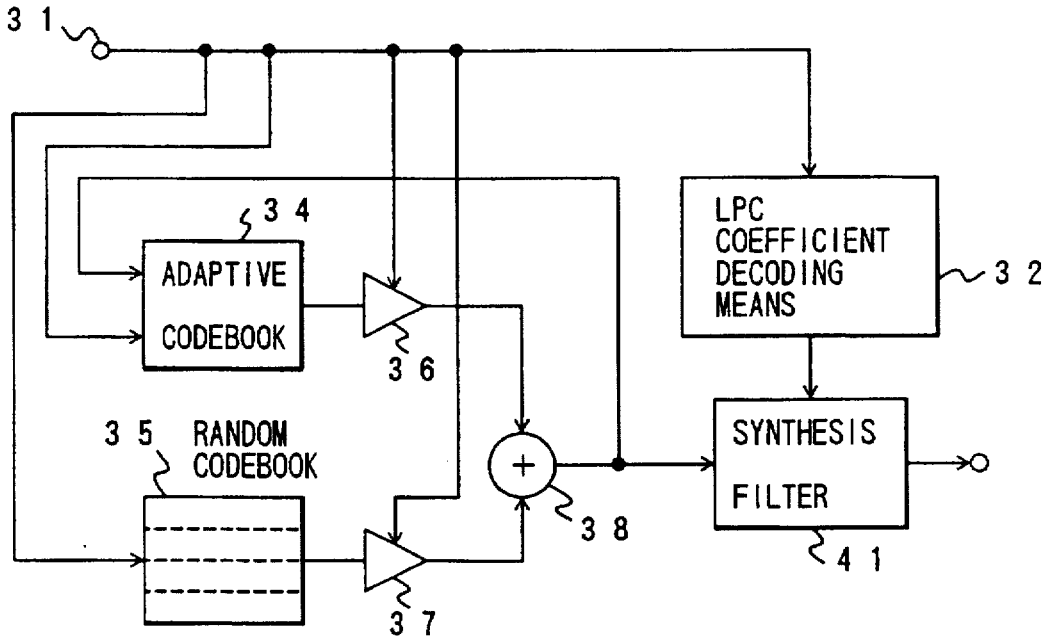

FIG. 5

A

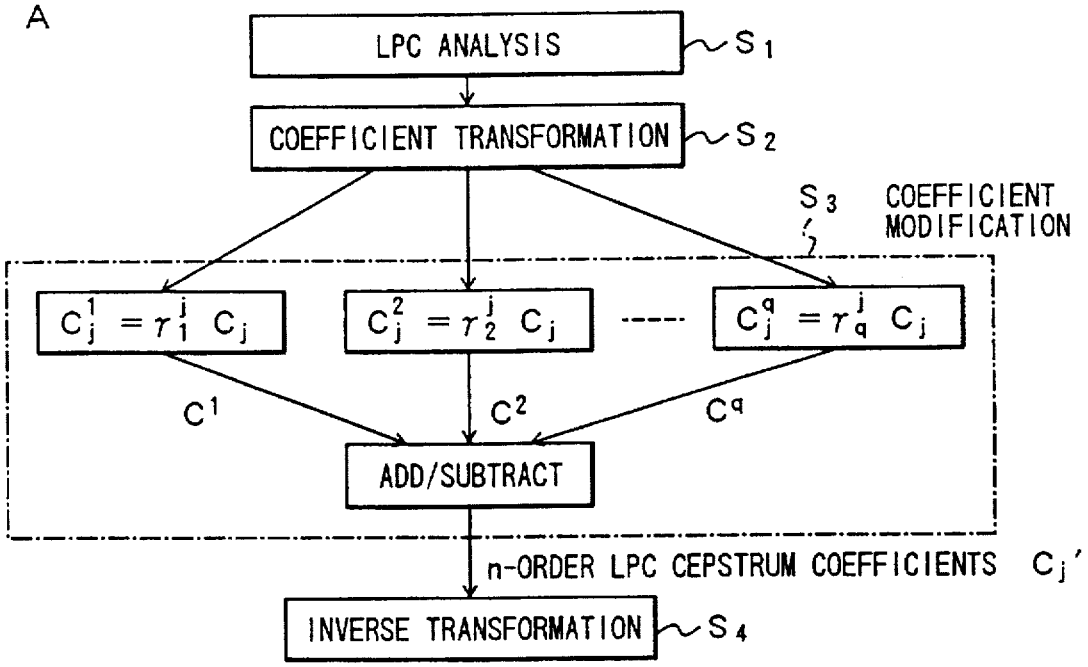

B $$C^1 = (\gamma_1^1 C_1, \gamma_1^2 C_2, \text{------}, \gamma_1^n C_n)$$
$$C^2 = (\gamma_2^1 C_1, \gamma_2^2 C_2, \text{------}, \gamma_2^n C_n)$$
$$\vdots \qquad \vdots \qquad \vdots \qquad \vdots$$
$$C^q = (\gamma_q^1 C_1, \gamma_q^2 C_2, \text{------}, \gamma_q^n C_n)$$

C $$C_1' = \gamma_1^1 C_1 + \gamma_2^1 C_1 -, \text{------}, + \gamma_q^1 C_1$$
$$C_2' = \gamma_1^2 C_2 + \gamma_2^2 C_2 -, \text{------}, + \gamma_q^2 C_2$$
$$\vdots \qquad \vdots \qquad \vdots \qquad \vdots$$
$$C_n' = \gamma_1^n C_n + \gamma_2^n C_n -, \text{------}, + \gamma_q^n C_n$$

METHOD FOR THE MODIFICATION OF LPC COEFFICIENTS OF ACOUSTIC SIGNALS

BACKGROUND OF THE INVENTION

The present invention relates to an LPC coefficient modification method which is used in the encoding or decoding of speech, musical or similar acoustic signals and, more particularly, to a method for modifying LPC coefficients of acoustic signals for use as filter coefficients reflective of human hearing or auditory characteristics or for modifying LPC coefficients of acoustic signals to be quantized.

A typical conventional method for low bit rate coding of acoustic signals by the linear prediction coding (hereinafter referred to as LPC) scheme is a CELP (Code Excited Linear Prediction) method. The general processing of this method is shown in FIG. 1A. An input speech signal from an input terminal 11 is LPC-analyzed by LPC analyzing means 12 every 5 to 10 ms frames or so, by which p-order LPC coefficients $\alpha_i$ (where i=1, 2, . . . , p) are obtained. The LPC coefficients $\alpha_i$ are quantized by quantizing means 13 and the quantized LPC coefficients are set as filter coefficients in an LPC synthesis filter 14. Usually, in this instance, for easy interpolation and easy stability check, the LPC coefficients $\alpha_i$ are transformed into LSP parameters, which are quantized (encoded), and for fitting conditions to those at the decoding side and easy determination of filter coefficients, the quantized LSP parameters are decoded and then inversely transformeded into LPC coefficients, which are used to determine the filter coefficients of the synthesis filter 14. Excitation signals for the synthesis filter 14 are stored in an adaptive codebook 15, from which the coded excitation signal (vector) is repeatedly fetched with pitch periods specified by control means 16 to one frame length. The stored excitation vector of one frame length is given a gain by gain providing means 17, thereafter being fed as an excitation signal to the synthesis filter 14 via adding means 18. The synthesized signal from the synthesis filter 14 is subtracted by subtracting means 19 from the input signal, then the difference signal (an error signal) is weighted by a perceptual weighting filter 21 in correspondence with a masking characteristic of human hearing, and a search is made by the control means 16 for the pitch period for the adaptive codebook 15 which minimizes the energy of the weighted difference signal.

Following this, noise vectors are sequentially fetched by the control means 16 from a random codebook 22, and the fetched noise vectors are individually given a gain by gain providing means 23, after which the noise vectors are each added by the adding means 18 to the above-mentioned excitation vector fetched from the adaptive codebook 15 to form an excitation signal for supply to the synthesis filter 14. As is the case with the above, the noise vector is selected, by the control means 16, that minimizes the energy of the difference signal (an error signal) from the perceptual weighting filter 21. Finally, a search is made by the control means 16 for optimum gains of the gain providing means 17 and 23 which would minimize the energy of the output signals from the perceptual weighting filter 21. An index representing the quantized LPC coefficients outputted from the quantizing means 13, an index representing the pitch period selected according to the adaptive codebook 15, an index representing the vector fetched from the noise codebook, and an index representing the optimum gains set in the gain providing means 17 and 23 are encoded. In some cases, the LPC synthesis filter 14 and the perceptual weighting filter 21 in FIG. 1A are combined into a perceptual weighting synthesis filter 24 as shown in FIG. 1B. In this instance, the input signal from the input terminal 11 is applied via the perceptual weighting filter 21 to the subtracting means 19.

The data encoded by the CELP coding scheme is decoded in such a manner as shown in FIG. 2A. The LPC coefficient index in the input encoded data fed via an input terminal is decoded by decoding means 32, and the decoded quantized LPC coefficients are used to set filter coefficients in an LPC synthesis filter 33. The pitch index in the input encoded data is used to fetch an excitation vector from an adaptive codebook 34, and the noise index in the input encoded data is used to fetch a noise vector from a noise codebook 35. The vectors fetched from the two codebooks 34 and 35 are given by gain providing means 36 and 37 gains individually corresponding to gain indexes contained in the input encoded data and then added by adding means 38 into an excitation signal, which is applied to the LPC synthesis filter 33. The synthesized signal from the synthesis filter 33 is outputted after being processed by a post-filter 39 so that quantized noise is reduced in view of the human hearing or auditory characteristics. As depicted in FIG. 2B, the synthesis filter 33 and the post-filter 39 may sometimes be combined into a synthesis filter 41 adapted to meet the human hearing or auditory characteristics.

The human hearing possesses a masking characteristic that when the level of a certain frequency component is high, sounds of frequency components adjacent thereto are hard to hear. Accordingly,.the error signal from the subtracting means 19 is processed by the perceptual weighting filter 21 so that the signal portion of large power on the frequency axis is lightly weighted and the small power portion is heavily weighted. This is intended to obtain an error signal of frequency characteristics similar to those of the input signal.

Conventionally, there are known as the transfer characteristic f(z) of the perceptual weighting filter 21 the two types of characteristics described below. The first type of characteristic can be expressed by equation (1) using a p-order quantized LPC coefficient $\hat{\alpha}$ and a constant $\gamma$ smaller than 1 (0.7, for instance) that are used in the synthesis filter 14.

$$f(z) = \left(1 + \sum_{i=1}^{P} \hat{\alpha}_i z^{-i}\right) / \left(1 + \sum_{i=1}^{P} \hat{\alpha}_i \gamma^i z^{i}\right) \tag{1}$$

In this instance, since the denominator of the transfer characteristic h(z) of the synthesis filter 14 and the numerator of the transfer characteristic f(z) are equal as shown in the following equation (2), the application to the perceptual weighting synthesis filter 24, that is, the application of the excitation vector to the perceptual weighting filter via the synthesis filter, means canceling the numerator of the characteristic f(z) and the denominator of the characteristic h(z) with each other; the excitation vector needs only to be applied to a filter of a characteristic expressed below by equation (3)—this permits simplification of the computation involved.

$$h(z) = 1/\left(1 + \sum_{i=1}^{P} \hat{\alpha}_i z^{-i}\right) \tag{2}$$

$$p(z) = 1/\left(1 + \sum_{i=1}^{P} \hat{\alpha}_i \gamma^i z^{-i}\right) \tag{3}$$

The second type of transfer characteristic of the perceptual weighting filter 21 can be expressed below by equation (4) using a p-order LPC coefficients (not quantized) $\alpha$ derived from the input signal and two constants $\gamma_1$ and $\gamma_2$ smaller than 1 (0.9 and 0.4, for instance).

$$f(z) = \left(1 + \sum_{i=1}^{P} \hat{\alpha}_i \gamma_1^i z^{-i}\right) / \left(1 + \sum_{i=1}^{P} \hat{\alpha}_i \gamma_2^i z^{-i}\right) \quad (4)$$

In this case, since the above-mentioned cancellation of the perceptual weighting filter characteristic with the synthesis filter characteristic using the quantized LPC coefficients $\hat{\alpha}$ is impossible, the computation complexity increases, but the use of the two constants $\gamma_1$ and $\gamma_2$ permits hearing or auditory control with higher precision than in the case of the first type using only one constant $\gamma$.

The postfilter 39 is provided to reduce quantization noise through enhancement in the formant region or in the higher frequency component, and the transfer characteristic f(z) of this filter now in wide use is given by the following equation.

$$f(z) = (1 - \mu z^{-1}) \left(1 + \sum_{i=1}^{P} \hat{\alpha}_i \gamma_3^i z^{-i}\right) / \left(1 + \sum_{i=1}^{P} \hat{\alpha}_i \gamma_4^i z^{-i}\right) \quad (5)$$

where $\hat{\alpha}$ is decoded p-order quantized LPC coefficients, $\mu$ is a constant for correcting the inclination of the spectral envelope which is 0.4, for example, and $\gamma_3$ and $\gamma_4$ are positive constants for enhancing spectral peaks which are smaller than 1, for instance, 0.5 and 0.8, respectively. The quantized LPC coefficients $\hat{\alpha}$ are used when the input data contains an index representing them as in the case of the CELP coding, and in the case of decoding data encoded by a coding scheme which does not use indexes of this kind, such as a mere ADPCM scheme, the LPC coefficients are obtained by an LPC analysis of the synthesized signal from the synthesis filter.

The filters in FIGS. 1 and 2 are usually formed as digital filters.

When the order p of the LPC coefficients $\alpha$ is 10, the multiplication in Eq. (2) needs to be conducted 10 times per sample, and in Eq. (4) the multiplication must be done 20 times per sample because $\alpha$ is contained in the numerator and the denominator. Assuming that the number of candidates for the adaptive codebook 15 and the random codebook 22 is 1024 and the number of samples of the excitation vector is 80, the number of times the multiplication per sample will be 2457600 (=30×80×1024). The filter coefficients can easily be calculated because of utilization of the LPC coefficients therefor, but this requires a great deal of computation.

As described above, the perceptual weighting filter employs only one or two parameters $\gamma$ or $\gamma_1$ and $\gamma_2$ for controlling its characteristic, and hence cannot provide a high precision characteristic well suited or adapted to the input signal characteristic. An increase in the number of control parameters, aimed at further improvement of the perceptual weighting characteristic, would increase the order of the filter. Since in the CELP encoding every excitation vector needs to be passed through the perceptual weighting filter, a filter structure intended for more complex perceptual weighting characteristic would appreciably increase the computational complexity, and hence is impractical.

The postfilter also uses only three parameters $\mu$, $\gamma_3$ and $\gamma_4$ to control its characteristic and cannot reflect the human hearing or auditory characteristic with high precision.

Also in digital filters of the type having their filter coefficients set through utilization of LPC coefficients of acoustic signals, fine control of their transfer characteristic with a small amount of computation could not have been implemented in general.

There has been proposed the application of such a linear prediction scheme to the frequency-domain coding of acoustic signals, in particular, musical signals.

Referring to FIG. 8, the proposed coding and decoding methods will be described. In an encoder 51 a digitized acoustic input signal sequence is input from an input terminal 53 into frame split (or signal segmentation) means 54, wherein an input sequence of two by N preceding samples is extracted every N input samples into an input frame of a two-by-N-sample length. This input frame is fed into windowing means 55, wherein it is multiplied by a window function. Then the input signal sequence output from the windowing means 55 is modified-discrete-cosine transformed by MDCT (Modified Discrete Cosine Transform) means 56 into an N-sample frequency-domain signal.

The input signal sequence, multiplied by a window function, is LPC analyzed by LPC analysis means 57 to obtain p-order prediction coefficients, which are quantized by quantization means 58. This quantization can be done by, for instance, an LSP quantization method that quantizes the prediction coefficients after transforming them into LSP parameters, or a method that quantizes the prediction coefficients after transforming them into k parameters. An index representing the quantized prediction coefficients is output from the quantization means 58.

The quantized prediction coefficients are also provided to frequency spectral envelope calculating means 61, by which their power spectra are calculated to obtain a frequency spectral envelope signal. That is, decoded prediction coefficients ($\alpha$ parameters) are FFT-analyzed (Fast Fourier Transform: Discrete Fourier Transform), then the power spectrum is calculated, and a reciprocal of its square root is Calculated to obtain a frequency spectral envelope signal.

In normalization means 62, each sample of the frequency-domain signal from the MDCT means 56 is normalized by being multiplied by each sample of the reciprocal of the frequency spectral envelope signal, thereby obtaining a flattened residual signal. In power normalization/gain quantization means 63, the residual signal is normalized into a normalized residual signal by being divided by an average value of its amplitude, then the amplitude average value is quantized, and an index 64 representing the quantized normalized gain is output.

The signal from the frequency spectral envelope calculating means 61, which is the reciprocal of the frequency spectral envelope, is controlled by a weight calculating means 65 through the use of a psycho-acoustic model and is rendered into a weighting signal.

In normalized residue quantization means 66, the normalized residual signal from the means 63 is adaptively-weighted vector-quantized by the weighting signal from the means 65. An index 67 representing the vector value quantized by the quantization means 66 is output therefrom. Thus the encoder 51 outputs the prediction coefficient quantized index 59, the gain quantized index 64 and the residue quantized index 67.

A decoder 52 decodes these indexes 59, 64 and 67 as described below. That is, the prediction coefficient quantized index 59 is decoded by decoding means 76 into the corresponding quantized prediction coefficients, which are provided to frequency spectral envelope calculating means 77, wherein the reciprocal of the frequency spectral envelope, that is, the reciprocal of the square root of the power spectral envelope is calculated in the same manner as in the frequency spectral envelope calculating means 61. The index 67 is decoded by decoding means 79 into the quantized normalized residual signal. The index 64 is decoded by decoding means 79 into the normalized gain (average amplitude). In power de-normalization means 81 the quantized normalized residual signal, decoded by the decoding means 78, is multiplied by the normalized gain from the decoding means 79 to obtain a power de-normalized quantized residual signal. In de-normalization (inverse processing of flattening) means 82 the quantized residual signal is de-flattened by being divided every sample by the reciprocal of the frequency spectral envelope from the frequency spectral envelope calculating means 77. In inverse MDCT means 83 the de-flattened residual signal is transformed into a time-domain signal by being subjected to N-order inverse discrete cosine transform processing. In windowing means 84 the time-domain signal is multiplied by a window function. The output from the windowing means 84 is provided to frame overlapping means 85, wherein former N samples of a 2N-sample long frame and latter N samples of the preceding frame are added to each other, and the resulting N-sample signal is provided to an output terminal 86.

The coding scheme described above is called a transform coding scheme as well and is suitable for encoding of relatively wideband acoustic signals such as musical signals.

With this encoding and decoding scheme, however, the decoder 52 decodes the quantized prediction coefficients from the index 59, then calculates their power spectra, then calculates their square root every sample, and calculates a reciprocal of the square root; the calculation of the square root for each sample requires an appreciably large amount of processing and constitutes an obstacle to real-time operation of the decoder on one hand and inevitably involves large-scale, expensive hardware therefor on the other hand.

If LPC coefficients representing the square root of the power spectral envelope are calculated and output as the aformentioned index 59 from the encoder 51 with a view to avoiding the above-mentioned defects, the decoder 52 will be able to omit the square root calculation, that is, to significantly reduce the computational complexity as a whole. However, no method has been proposed so far which permits a high precision calculation of the prediction coefficients representing the square root of the power spectral envelope.

Conventionally, in the case of processing high-order LPC coefficients for modification or quantization, computational precision is required to obtain stable coefficients. For example, the quantization of the LPC coefficients for determining the filter coefficients of the synthesis filter 14 in FIG. 1A is usually carried out after transforming the coefficients into LSP parameters, and in the encoding of wide band speech about 20 orders of LPC coefficients are needed to achieve satisfactory performance. However, when the spectral peak of the input data is so sharp that the space between the LSP parameters is very narrow in the course of transforming about 20 orders of LSP parameters into LPC coefficients, high computational precision is needed, but its implementation is particularly difficult in a fixed-point DSP (Digital Signal Processor). This problem could be solved by using twice a filter with a square root power spectral characteristic, but a high precision square root power spectral envelope cannot be obtained.

It is well-known in the art to transform the LPC coefficients into LPC cepstrum coefficients and perform signal processing in the LPC cepstrum domain. Such processing is described in, for example, Japanese Pat. Laid-Open Gazette No. 188994/93 (corresponding to U.S. Pat. No. 5,353,408 issued Oct. 4, 1994). With the scheme disclosed in the Japanese gazette, however, the inverse transformation of the LPC cepstrum coefficients into the LPC coefficients is performed using a recursive equation, with the order of the LPC cepstrum coefficients truncated at the order of the LPC coefficients desired to obtained. Such an inverse transformation often results in the generation of coefficients of entirely different spectral characteristics. In other words, the original LPC coefficients cannot be modified as desired.

It is therefore an object of the present invention to provide a method for the modification of LPC coefficients of acoustic signals with which it is possible to obtain LPC coefficients of a spectral envelope close to a desired one by relatively simple processing, that is, by a small amount of computation.

An object of the present invention is to provide a method of modifying LPC coefficients for use in a perceptual weighting filter.

Another object of the present invention is to provide an LPC coefficient modifying method with which it is possible to control LPC coefficients for use in a perceptual weighting filter more minutely than in the past and to obtain a spectral envelope close to a desired one of an acoustic signal.

Still another object of the present invention is to provide an LPC coefficient modifying method according to which LPC coefficients for determining coefficients of a filter to perceptually suppress quantization noise can be controlled more minutely than in the past and a spectral envelope close to a desired one of an acoustic signal.

SUMMARY OF THE INVENTION

In a first aspect, the present invention is directed to an LPC coefficient modifying method in which p-order LPC coefficients of an acoustic signal are transformed into n-order (where n>p) LPC cepstrum coefficients, then the LPC cepstrum coefficients are modified, and the modified LPC cepstrum coefficients are inversely transformed by the method of least squares into n-order (where m<n) LPC coefficients in the LPC cepstrum domain.

The above modification is performed by dividing each order of LPC cepstrum coefficient by two.

In a second aspect, the present invention is directed to an LPC coefficient modifying method which is used in a coding scheme for determining indexes to be encoded in such a manner as to minimize the difference signal between an acoustic input signal and a synthesized signal of the encoded indexes and modifies LPC coefficients for use as filter coefficients of an all-pole or moving average digital filter that performs weighting of the difference signal in accordance with human hearing or auditory or psycho-acoustic characteristics. The p-order LPC coefficients of the input signal are transformed into n-order (where n>p) LPC cepstrum coefficients, then the LPC cepstrum coefficients are modified into n-order modified LPC cepstrum coefficients, and the modified LPC cepstrum coefficients are inversely transformed by the method of least squares into new m-order (where m<n) LPC coefficients for use as the filter coefficients.

In a third aspect, the present invention is directed to an LPC coefficient modifying method which is used in a coding scheme for determining indexes to be encoded in such a manner as to minimize the difference signal between an acoustic input signal and a synthesized signal of the encoded indexes and modifies LPC coefficients for use as filter coefficients of an all-pole or moving average digital filter that synthesizes the above-said synthesized signal and performs its weighting in accordance with human psycho-acoustic characteristics. The p-order LPC coefficients $\alpha_i$ of the input signal and their quantized LPC coefficients $\hat{\alpha}_i$ are respectively transformed into n-order (where n>p) LPC cepstrum coefficients, then the LPC cepstrum coefficients transformed from the LPC coefficients are modified into n-order modified LPC cepstrum coefficients, then the LPC cepstrum coefficients transformed from the quantized LPC coefficients and the modified LPC cepstrum coefficients are added together, and the added LPC cepstrum coefficients are inversely transformed by the method of least squares into new m-order (where m<n) LPC coefficients for use as the filter coefficients.

According to the second and third aspects of the invention, the relationship between the input signal and the corresponding masking function chosen in view of human psycho-acoustic characteristics is calculated in the n-order LPC cepstrum domain and this relationship is utilized for the modification of the LPC cepstrum coefficients.

In a fourth aspect, the present invention is directed to a method which modifies LPC coefficients for use as filter coefficients of an all-pole or moving average digital filter that perceptually or psycho-acoustically suppresses quantization noise for a synthesized signal of decoded input indexes of coded speech or musical sounds. The p-order LPC coefficients derived from the input index are transformed into n-order (where n>p) LPC cepstrum coefficients, then the LPC cepstrum coefficients are modified into n-order modified LPC cepstrum coefficients, and the modified LPC cepstrum coefficients are inversely transformed by the method of least squares into new m-order (where m<n) LPC coefficients for use as the filter coefficients.

In a fifth aspect, the present invention is directed to a method which modifies LPC coefficients for use as filter coefficients of an all-pole or moving average digital filter that synthesizes a signal by using p-order LPC coefficients in the input indexes and perceptually or psycho-acoustically suppresses quantization noise for the synthesized signal. The p-order LPC coefficients are transformed into n-order (where n>p) LPC cepstrum coefficients, then the LPC cepstrum coefficients are modified into n-order modified LPC cepstrum coefficients, then the modified LPC cepstrum coefficients and the LPC cepstrum coefficients are added together, and the added LPC cepstrum coefficients are inversely transformed by the method of least squares into new m-order (where m<n) LPC coefficients for use as the filter coefficients.

According to the fourth and fifth aspects of the invention, the relationship between the input-index decoded synthesized signal and the corresponding enhancement characteristic function chosen in view of human psycho-acoustic characteristics is calculated in the n-order LPC cepstrum domain and this relationship is utilized for the modification of the LPC cepstrum coefficients.

According to the second through fifth aspects of the invention, the modification is performed by multiplying the LPC cepstrum coefficients $c_j$ (where j=1, 2, . . . , n) by a constant $\beta_j$ based on the above-mentioned relationship.

According to the second through fifth aspects of the invention, q (where q is an integer equal to or more than 2) positive constants $\gamma_k$ (where k=1, . . . , q), which are equal to or smaller than 1), are determined, then the LPC cepstrum coefficients $c_j$ (where j=1, 2, . . . , n) are multiplied by $\gamma_K^i$ to obtain q LPC Cepstrum coefficients, and the modification is performed by adding or subtracting the q $\gamma_k^i$-multiplied LPC cepstrum coefficients on the basis of the afore-mentioned relationship.

BRIEF DESCRIPTION OF THE DRAWINGS

FIGS. 2A and B are block diagrams showing prior art CELP coded data decoding schemes;

FIG. 5A is a flowchart illustrating a modified procedure in modification step $S_3$ in FIG. 3A;

FIG. 5B is a diagram showing modified LPC cepstrum coefficients $C^1, \ldots, C^q$ obtained by multiplying LPC cepstrum coefficients $c_j$ by constants $\gamma_1^j, \ldots \gamma_q^j$, respectively, in the processing in the flowchart of FIG. 5A;

FIG. 5C is a diagram showing respective elements of modified LPC cepstrum coefficients $c_j$ obtained by integrating the modified LPC cepstrum coefficients $C^1, \ldots, C^q$;

DESCRIPTION OF THE PREFERRED EMBODIMENTS

Figure 3:
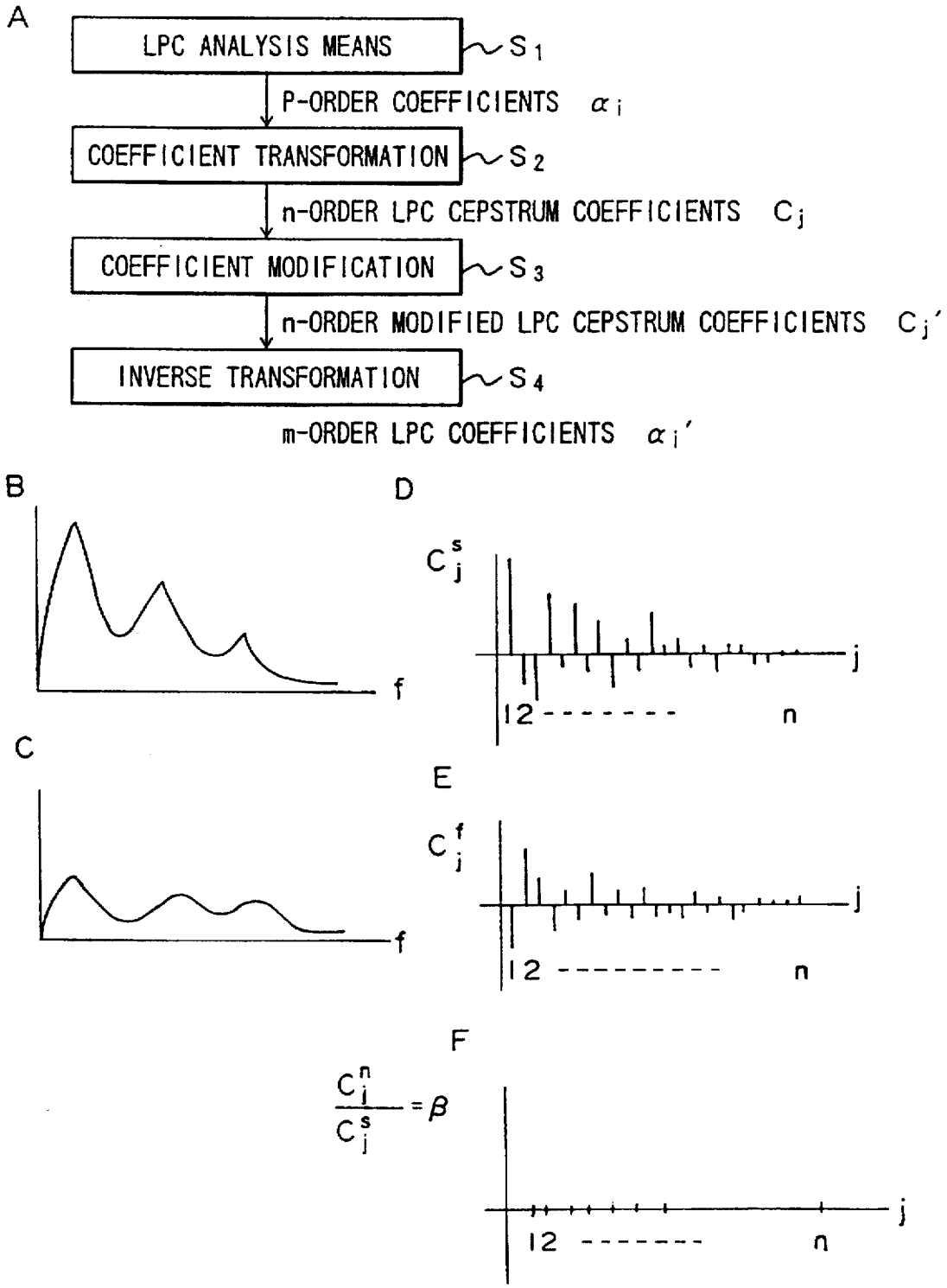
FIG. 3A is a flowchart showing the procedure of an embodiment according to the first aspect of the present invention.
FIG. 3B is a graph showing an example of a log power spectral envelope of an input signal.
FIG. 3C is a graph showing an example of the log power spectral envelope of a masking function suited to the input signal shown in FIG. 3B.
FIGS. 3D and E are graphs showing examples of LPC cepstrum coefficients transformed from the power spectral envelopes depicted in FIGS. 3B and C, respectively.
FIG. 3F is a graph showing the ratio between the corresponding orders of LPC cepstrum coefficients in FIGS. 3D and E.

In FIG. 3A there is shown the general procedure according to the first aspect of the present invention. A description will be given first of an application of the present invention to the determination of filter coefficients of an all-pole perceptual weighting filter in the coding scheme shown in FIG. 1A according to the second aspect of the invention. The procedure begins with an LPC analysis of the input signal to obtain p-order LPC coefficients $\alpha_i$ (where i=1, 2, . . . , p) ($S_1$). The LPC coefficients $\alpha_i$ can be obtained with the LPC analysis means 12 in FIG. 1. The next step is to derive n-order LPC cepstrum coefficients $c_n$ from the LPC coefficients $\alpha_i$ ($S_2$). The procedure for this calculation is performed using the known recursive equation (6) shown below. The order p is usually set to 10 to 20 or so, but to reduce a truncation or discretization error, the order n of the LPC cepstrum needs to be twice or three times the order p.

$$c_j = \alpha_j;\ j = 1 \tag{6}$$

$$c_j = -\sum_{k=1}^{j} (1-(k/j))\alpha_k c_{j-k} - \alpha_j;\ 1 < j \leqq p$$

$$c_j = -\sum_{k=1}^{j} (1-(k/j))\alpha_k c_{j-k};\ p < j \leqq n$$

Next, the LPC cepstrum coefficient $c_j$ are modified for adaptation to the perceptual weighting filter ($S_3$). For example, in the case where the log power spectral envelope characteristic based on the LPC analysis of an average input signal is such as shown in FIG. 3B and the log power spectral envelope characteristic of a masking function favorable for the above characteristic is such as shown in FIG. 3C, the log power spectral envelope characteristics of these average input signal and masking function are inverse-Fourier transformed to obtain n-order LPC cepstrum coefficients $c_j^s$ and $c_j^f$ such as depicted in FIGS. 3D and E, respectively. For example, the ratio, $\beta_j = c_j^f / c_j^s$, between both n-order LPC cepstrum coefficients of each order is calculated to obtain the relationship $\beta_j$ between the input signal and the masking function. The LPC cepstrum coefficients $c_j$ are modified into n-order LPC cepstrum coefficients $c_j'$ through utilization of the relationship. This relationship only needs to be examined in advance. The modification is done by, for instance, multiplying every LPC cepstrum coefficient $c_j$ by the corresponding ratio $\beta_j$ (where j=1, . . . , n) to obtain the modified LPC cepstrum coefficient $c_j' = c_j \beta_j$.

Thereafter, the modified LPC cepstrum coefficients $c_j'$ are inversely transformed into new m-order LPC coefficients $\alpha_i'$ ($S_4$), where m is an integer nearly equal to p. This inverse transformation can be carried out by reversing the above-relationship between the LPC cepstrum coefficients and the LPC coefficients, but since the number n of modified LPC cepstrum coefficients $c_j'$ is far larger than the number m of LPC coefficients $\alpha_j'$, there do not exist the LPC coefficients $\alpha_j'$ from which all the modified LPC cepstrum coefficients $c_j$ are derived. Therefore, by regarding the above-said relationship as a recursive equation, the method of least squares is used to calculate the LPC coefficients $\alpha_j'$ that minimize the square of a recursion error $e_j$ of each modified LPC cepstrum coefficient $c_j'$. In this instance, since the stability of the filter using thus calculated LPC coefficients $\alpha_i'$ is not guaranteed, the coefficients $a_i'$ are transformed into PARCOR coefficients, for instance, and a check is made to see if the value of each order is within ±1, by which the stability can be checked. The relationship between the new LPC coefficients $a_1'$ and the modified LPC cepstrum coefficients $c_j'$ is expressed by such a matrix as follows:

$$A^T = [\alpha_1', \ldots, \alpha_m'] \tag{7}$$
$$C^T = [c_1', \ldots, c_n'] \tag{8}$$

-continued $$D = \begin{pmatrix} 1 & 0 & \ldots & 0 \\ \frac{1}{2} c_1' & 1 & \ldots & 0 \\ \frac{2}{3} c_2' & \frac{1}{3} c_1' & \ldots & 0 \\ \ldots & \ldots & \ldots & \ldots \\ \frac{(m-1)}{m} c_{m-1}' & \frac{(m-1)}{m} c_{m-2}' & \ldots & 1 \\ \ldots & \ldots & \ldots & \ldots \\ \frac{(n-1)}{n} c_{n-1}' & \frac{(n-2)}{n} c_{n-2}' & \ldots & \frac{(n-m)}{n} c_{n-m}' \end{pmatrix} \tag{9}$$

$$E^T = [e_1, \ldots, e_n] \tag{10}$$
$$E = DA + C \tag{11}$$

The following normal equation needs only to be solved using the above relationship so as to minimize the recursion error energy $d = E^T E$ of the modified LPC cepstrum coefficients $c_j'$:

$$D^T DA = -D^T C \tag{12}$$

The thus obtained new m-order LPC coefficients $\alpha_i'$ are used as the filter coefficients of the all-pole perceptual weighting filter 21.

As described above, the n-order LPC cepstrum coefficients $c_j$ are modified according to the relationship between the input signal and its masking function. Since the modification utilizes the aforementioned ratio $\beta_j$, the n elements of the LPC cepstrum coefficients $c_j$ can all be differently modified and the modified LPC cepstrum coefficients $c_j'$ are inversely transformed into the m-order LPC coefficients $\alpha_i'$; since in this case every element of the coefficients $\alpha_i'$ is reflective of the corresponding element of the n-order modified LPC cepstrum coefficients $c_j'$, the new LPC coefficients $\alpha_i'$ can be regarded as being modified more freely and minutely than in the prior art. In the prior art, the first type merely multiplies i-order LPC cepstrum coefficients $c_i$ by $\gamma^1$—this only monotonically attenuates the LPC cepstrum coefficients on the quefrency. The second type also merely multiplies the i-order LPC cepstrum coefficients $c_1$ by $(-\gamma_1^i + \gamma_2^i)$. In contrast to the prior art, the present invention permits individually modifying all the elements of the LPC cepstrum coefficients $c_i$ and provides a far higher degree of freedom than in the past; hence, it is possible to minutely control the LPC cepstrum coefficients to undergo slight variations in the spectral envelope while monotonically attenuating them on the quefrency. Additionally, the order of the perceptual weighting filter 21 is enough to be m, and for example, if m=p, the computational complexity in the filter is the same as in the case of the first type. Since the coefficients are calculated as LPC coefficients, the filter coefficients of the filter 21 can easily be determined. As referred to previously herein, the order of the new LPC coefficients $\alpha'$ need not always be equal to p. The order m may be set to be larger than p to increase the approximation accuracy of the synthesis filter characteristic or smaller than p to reduce the computational complexity.

Figure 4:
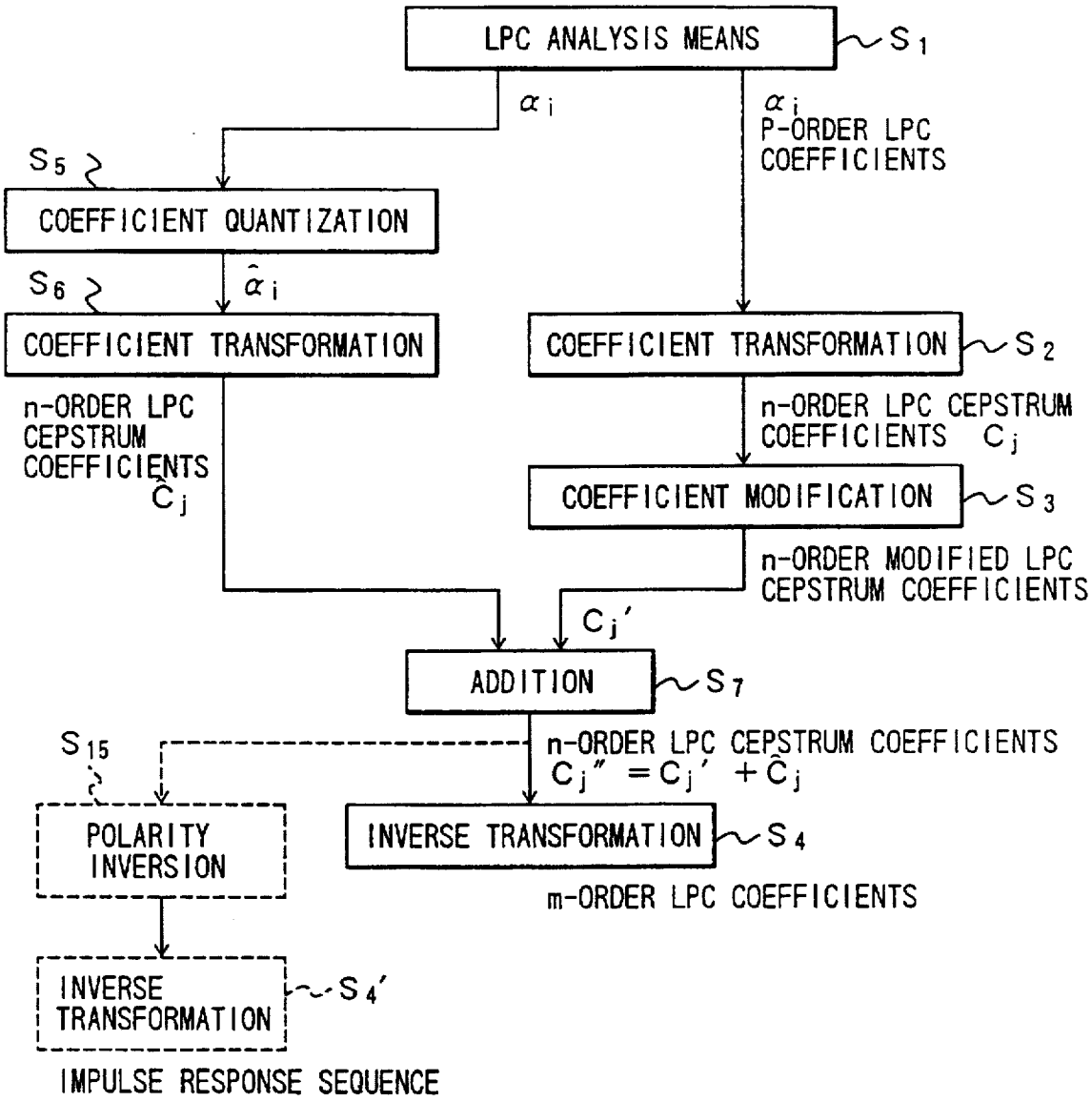
FIG. 4 is a flowchart illustrating the procedure of an embodiment according to the third aspect of the present invention.

In FIG. 4 there is shown the procedure of an embodiment according to the third aspect of the present invention that is applied to the determination of the filter coefficients of the all-pole filter 24 that is a combination of the LPC synthesis filter and the perceptual weighting filter in FIG. 1B. Since the conditions in the encoder may preferably be fit to those in the decoder, the LPC coefficients in this example are those quantized by the quantization means 13 in FIG. 1A, that is, the LPC coefficients $\alpha_i$ are quantized into quantized LPC coefficients $\hat{\alpha}_i$($S_5$). The temporal updating of the filter coefficients of the synthesis filter 24 also needs to be synchronized with the timing for outputting the index of the LPC coefficients $\hat{\alpha}_i$. As opposed to this, the filter coefficients of the perceptual weighting filter need not be quantized and the temporal updating of the filter coefficients is also free. Either set of LPC coefficients are transformed into n-order LPC cepstrum coefficients $c_j$. That is, the LPC coefficients $\alpha_i$ are transformed into n-order LPC cepstrum coefficients $c_j$ ($S_2$) and the quantized LPC coefficients $\hat{\alpha}1$ are also transformed into n-order LPC cepstrum coefficients $\hat{c}_j$ (S6). The perceptual weighting LPC coefficients $\alpha_1$ are transformed using, for example, the same masking function as in the case of FIG. 3A ($S_3$) and the transformed LPC cepstrum coefficients $c_j'$ are combined with the transformed LPC cepstrum coefficients $\hat{c}_j$ of the quantized LPC coefficients into a single set of LPC cepstrum coefficients $c_j''$ ($S_7$). The cascade connection of filters in the time domain, that is, the cascade connection of the synthesis filter and the perceptual weighting filter corresponds to the addition of corresponding LPC cepstrum coefficients for each order. Therefore, the combination can be achieved by adding two sets of LPC cepstrum coefficients $c_j$ and $\hat{c}_j$ for each corresponding order so that $c_j=c_j'+\hat{c}_j$.

Finally, the n-order LPC cepstrum coefficients $c_j''$ are inversely transformed into m-order LPC coefficients of the all-pole synthesis filter as is the case with FIG. 3A ($S_4$). In this case, by inverting the polarity of all the LPC cepstrum coefficients $c_j''$ ($S_{15}$) and inversely transforming them into LPC coefficients ($S_4'$) as indicated by the broken lines in FIG. 4, it is possible to obtain moving average filter coefficients (FIR filter coefficients=an impulse response sequence). In the approximation of the same characteristic, the number of orders is usually smaller with the all-pole filter than with the moving average one, but latter may sometimes be preferable in terms of stability of the synthesis filter.

Next, a description will be given, with reference to FIG. 5A, of another example of the modification of the LPC cepstrum coefficients $c_j$. In this example, q (where q is an integer equal to or greater than 2) positive constants $\gamma_k$ (where k=1, 2, . . . , q) equal to or smaller than 1 are determined on the basis of an average relationship between the input signal and the masking function, and the LPC cepstrum coefficients $c_j$ are modified for each constant $\gamma_k$. For instance, each order (element) of LPC cepstrum coefficient $c_j$ is multiplied by $\gamma_k^i$ to create q modified LPC cepstrum coefficients $C^k$ (where k=1, 2, . . . , q) shown in FIG. 5B, and these q modified LPC cepstrum coefficients $C^k$ of each order are added to or subtracted from each other on the basis of the above-mentioned relationship to obtain an integrated set of modified LPC cepstrum coefficients $c_j'$ as depicted in FIG. 5C. Finally, the LPC cepstrum coefficients $c_j'$ is inversely transformed into m-order LPC coefficients ($S_4$) as in the embodiments described above.

To multiply the LPC cepstrum coefficient of j-th order by the j-th power of the constant $\gamma$, that is, to calculate $\gamma^j c_j$, is equivalent to the substitution of $z/\gamma$ for a polynomial z in the time domain; this scheme features ensuring the stability of the synthesis filter according to a combination of operations involved. In the present invention, however, a final stability check of the filter is required as referred to previously herein because of truncation of the LPC cepstrum coefficients to a finite order and the use of the method of least squares for calculating LPC coefficients.

Figure 6:
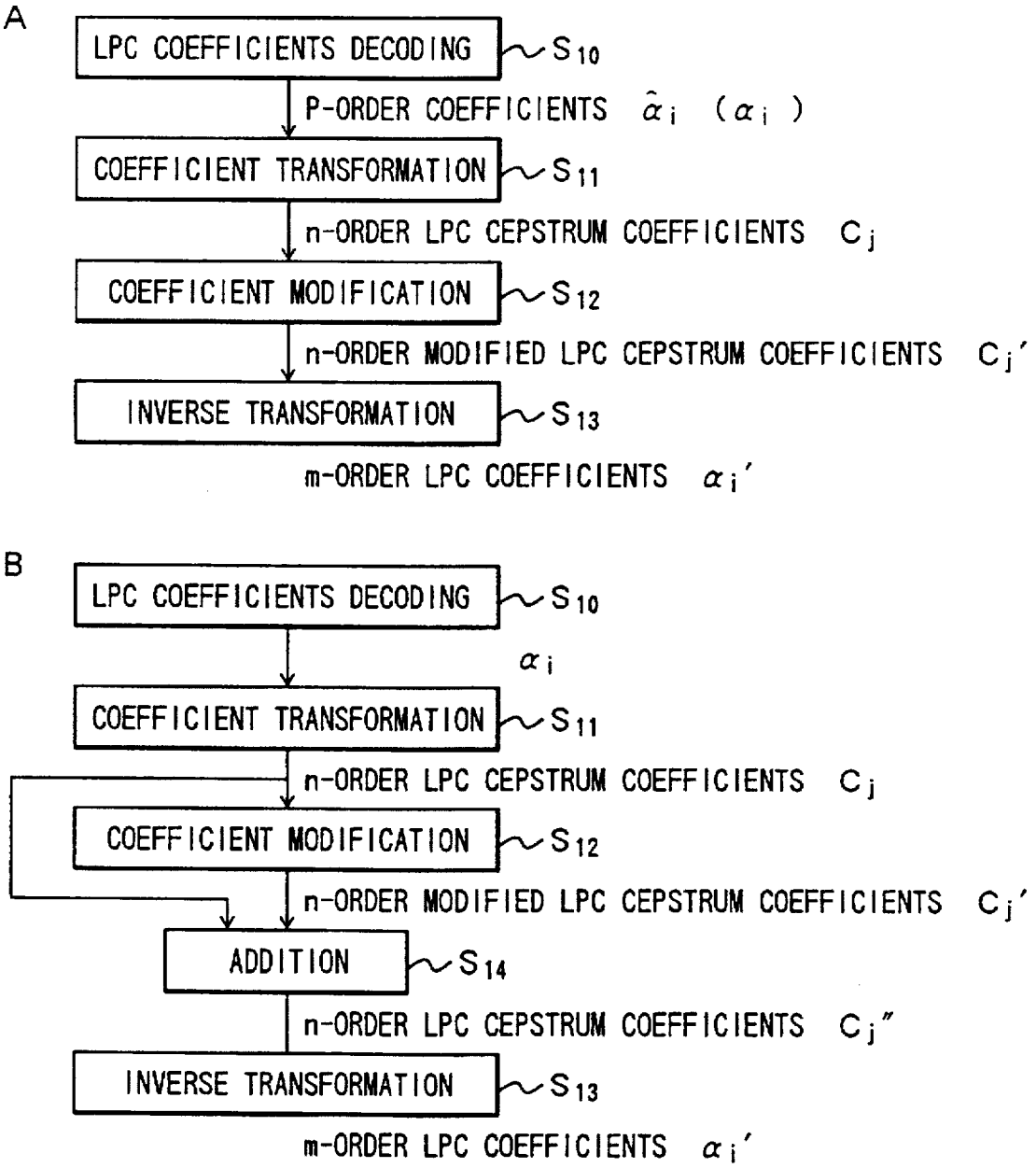
FIG. 6A is a flowchart showing the procedure of an embodiment according to the fourth aspect of the present invention.
FIG. 6B is a flowchart showing the procedure of an embodiment according to the fifth aspect of the present invention.

Turning now to FIG. 6A, an embodiment according to the fourth aspect of the present invention will be described. In the first place, LPC coefficients are derived from input data ($S_{10}$). That is, as in the decoder of FIG. 2, when the input data contains an index representing quantized LPC coefficients, the index is decoded into p-order quantized LPC coefficients $\hat{\alpha}_i$. When such an index is not contained in the input data as in the case of ADPCM or when the filter coefficients of the postfilter 39 are set with a period shorter than that of the input data, no index representing quantized LPC coefficients may sometimes be contained in the input data; in these cases, the decoded synthesized signal is LPC-analyzed to obtain the p-order LPC coefficients $\alpha_i$.

Following this, the LPC coefficients $\hat{\alpha}_i$ (or $\alpha_i$) are transformed into n-order LPC cepstrum coefficients $c_j$ ($S_{11}$). This transformation may be carried out in the same manner as in step $S_2$ in FIG. 3A. The LPC cepstrum coefficients are modified into n-order LPC cepstrum coefficients $c_j'$ ($S_{12}$). This is performed in the same manner as described previously with respect to FIGS. 3B through E. That is, a log power spectral envelope of an average decoded synthesized signal and a log power spectral envelope of an enhancement function for enhancement in the formant region or enhancement in the higher component, which is suitable for suppressing its quantization noise, are calculated, then the two corresponding spectral envelopes are subjected to inverse Fourier transformation to obtain n-order LPC cepstrum coefficients $c_i^s$ and $c_j^f$, and, for example, the ratio $\beta_j=c_j^f/c_j^s$ between the corresponding orders (elements) of both n-order LPC cepstrum coefficients is calculated to obtain the relationship of correspondence between the decoded synthesized signal and the enhancement function. Based on this relationship, every order of the LPC cepstrum coefficient $c_j$ is multiplied by, for example, the afore-mentioned ratio $\beta_j$ (where j=1, 2, . . . , n) corresponding thereto to obtain the modified LPC cepstrum coefficients $c_j'=\beta_j c_j$.

The thus obtained modified LPC cepstrum coefficients $c_j'$ are inversely transformed into m-order LPC coefficients $\alpha_i'$ to obtain the filter coefficients of the all-pole postfilter 39 ($S_{13}$), where m is an integer nearly equal to p. This inverse transformation takes place in the same manner as in inverse transformation step $S_4$ in FIG. 3A. Thus the present invention permits independent modification of all orders (elements) of the LPC cepstrum coefficients $c_j$ transformed from the decoded quantized LPC coefficients and provides a higher degree of freedom than in the past, enabling the characteristic of the postfilter 39 to closely resemble the target enhancement function with higher precision than in the prior art.

In FIG. 6B there is shown an embodiment according to the fifth aspect of the present invention for determining the filter coefficients of the synthesis filter 41 in FIG. 2B formed by integrating the LPC synthesis filter 33 and the postfilter 39 in FIG. 2A. As in the case of FIG. 6A, p-order LPC coefficients $\alpha_i$ are derived from the input data (S10), then the p-order LPC coefficients $\alpha_i$ are transformed into n-order LPC cepstrum coefficients $c_j$ ($S_{11}$), and the LPC cepstrum coefficients $c_j$ are modified into n-order LPC cepstrum coefficients $c_j'$ ($S_{12}$). The modified LPC cepstrum coefficients $c_j$ and the non-modified LPC cepstrum coefficients $c_j$ are added together for each order to obtain n-order LPC cepstrum coefficients $c_j''$ ($S_{14}$), which are inversely transformed into m-order LPC coefficients $\alpha_j'$ ($S_{13}$). In step (S13), as referred to previously herein with respect to the FIG. 4 embodiment, the moving average filter coefficients may be obtained by inverting the polarity of all the modified LPC cepstrum coefficients $c_j''$ and inversely transforming them into LPC coefficients.

Figure 7:
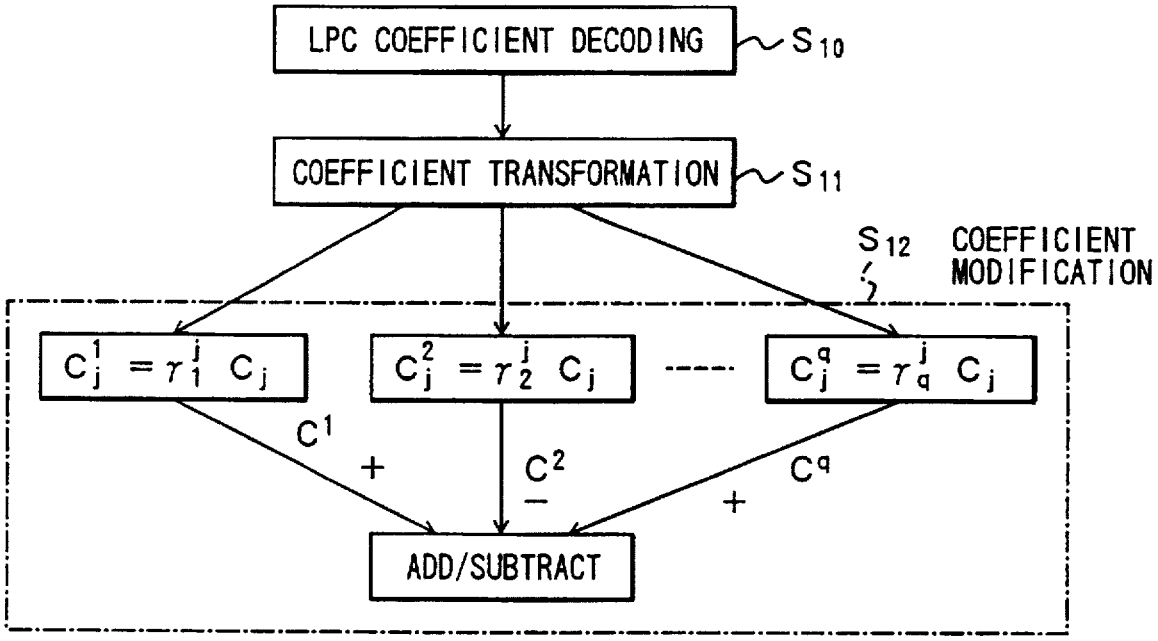
FIG. 7 is a flowchart showing an example of the procedure in the coefficient modifying step in FIGS. 6A and 6B.

In the coefficient modifying steps ($S_{12}$) in FIG. 6A and B, the coefficients can also be modified in the same manner as in the coefficient modifying step ($S_3$). That is, as shown in FIG. 7, q positive constants $\gamma_k$ (where k=1, . . . , q), equal to or smaller than 1, are determined in accordance with the relationship between the aformentioned decoded synthesized signal and the enhancement function, then the LPC cepstrum coefficients $c_j$ are respectively multiplied by $\gamma_k^j$ to obtain coefficients $\gamma_1^j c_j, \gamma_2^j c_j, \ldots, \gamma_q^j c_j$, and these coefficients are added or subtracted for each order (for each element) on the basis for the relationship between the decoded synthesized signal and the enhancement function to obtain integrated modified LPC cepstrum coefficients $c_j'$.

Figure 8:
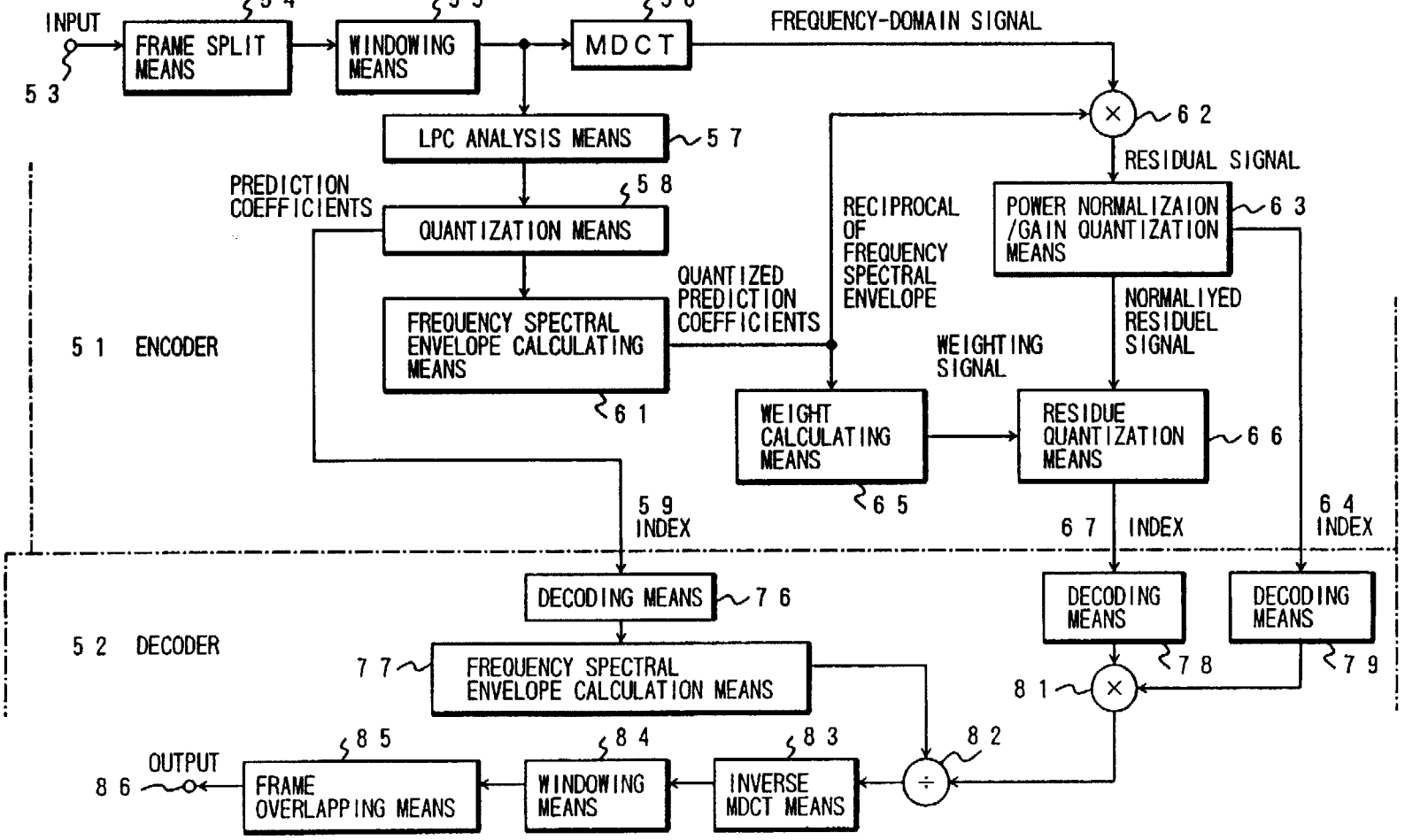
FIG. 8 is a block diagram illustrating a proposed transform encoder and decoder.
Figure 9:
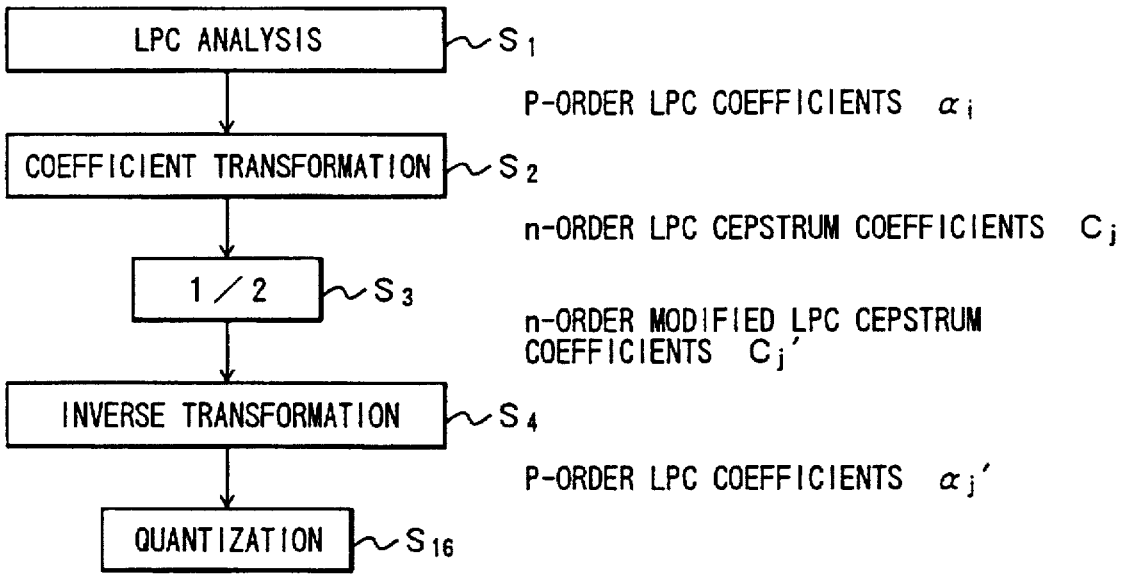
FIG. 9 is a flowchart showing the procedure of the present invention applied to auxiliary coding in the transform coding.

For example, in the transform coding scheme described previously in respect of FIG. 8, an input acoustic signal is LPC-analyzed for each frame to obtain p-order LPC coefficients $\alpha_i$, which are transformed into n-order LPC cepstrum coefficients $c_j$ ($S_2$) as shown in FIG. 9. This transformation can be performed in the same manner as in step $S_2$ in FIG. 3A. In this embodiment, the n-order LPC cepstrum coefficients $c_j'$ are multiplied for each order (each element) by 0.5 (divided by 2) to obtain n-order modified LPC cepstrum coefficients $c_j'$ ($S_3$), which are then inversely transformed into p-order LPC coefficients $\alpha_i'$ ($S_4$). This inverse transformation is carried out in the same manner a in step $S_4$ in FIG. 3A. The p-order LPC coefficients $\alpha_i'$ are quantized for output as an index from the encoder ($S_{16}$). This index is decoded, though not shown, and as depicted in FIG. 8, the decoded LPC coefficients are used to calculate the reciprocal of the square root of the power spectral envelope, then the acoustic input signal is transformed by the square root of the power spectrum envelope into a frequency-domain signal, and its residual signal is vector-quantized. Since in the LPC cepstrum domain the square root of the power spectral envelope is obtained simply by multiplying all orders (all elements) of the coefficients by 0.5, the LPC coefficients $\alpha_i'$ that are obtained in step $S_4$ correspond to the square root of the power spectral envelope of the input signal. Hence, decoding the index obtained in step $S_{15}$ in the decoder, the coefficients corresponding to the square root of the power spectral envelope of the input signal are obtained, so that no square root calculation is necessary and the computational complexity decreases accordingly.

Figure 10:
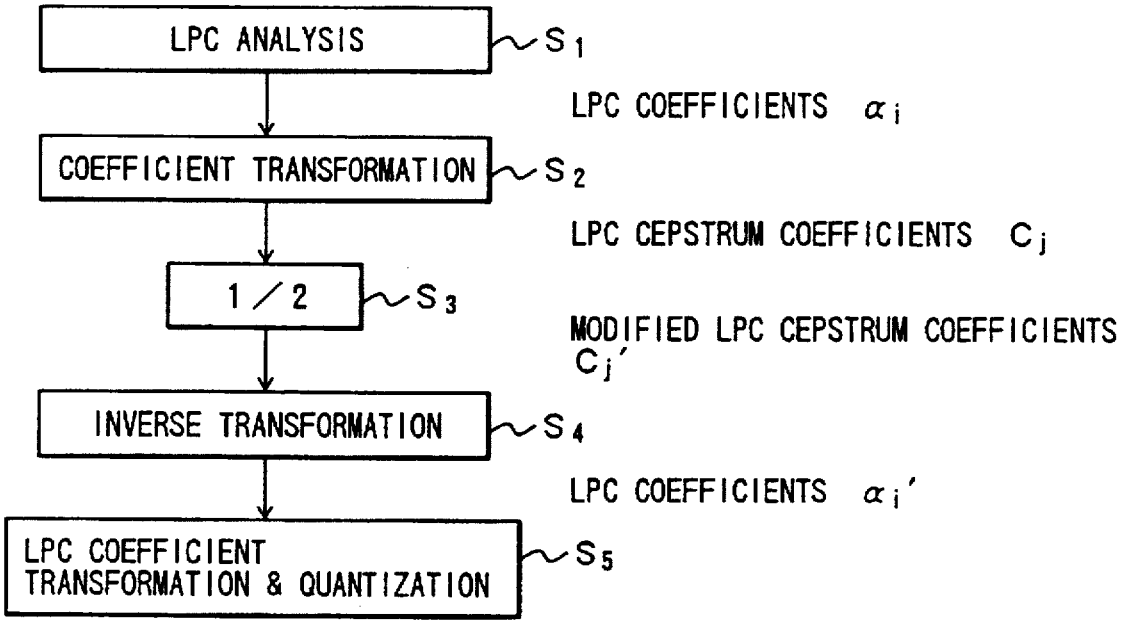
FIG. 10 is a flowchart showing the procedure of still another embodiment according to the present invention.
Figure 11:
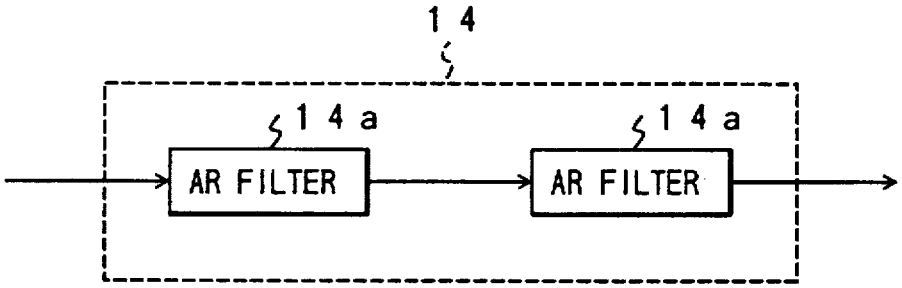
FIG. 11 is a block diagram illustrating a synthesis filter structure utilizing the modified procedure in FIG. 10.

As mentioned previously in relation to the background of the invention, high precision computations may sometimes be needed to transform high-order LPC parameters into LPC coefficients. According to the present invention, as shown in FIG. 10, the input signal is subjected to, for example, 20 orders of LPC analysis ($S_1$), then the resulting LPC coefficients $\alpha_i$ are transformed into 40 to 80 orders of LPC cepstrum coefficients $c_j$ ($S_2$), then each element of the LPC cepstrum coefficients $c_j$ is multiplied by ½ to obtain modified LPC cepstrum coefficients $c_j'$ ($S_3$), then the modified LPC cepstrum coefficients $c_j'$ are inversely transformed into 20 orders of LPC coefficients $\alpha_i'$ ($S_4$), then the LPC coefficients $\alpha_i'$ are transformed into LSP parameters, and the LSP parameters are quantized ($S_5$). The quantized LSP parameters are transformed into 20 orders of LPC coefficients to obtain filter coefficients of an autoregressive filter. As depicted in FIG. 11, a pair of such filters 14*a* each having set therein the filter coefficients are connected in cascade to form the LPC synthesis filter 14.

Figure 12:
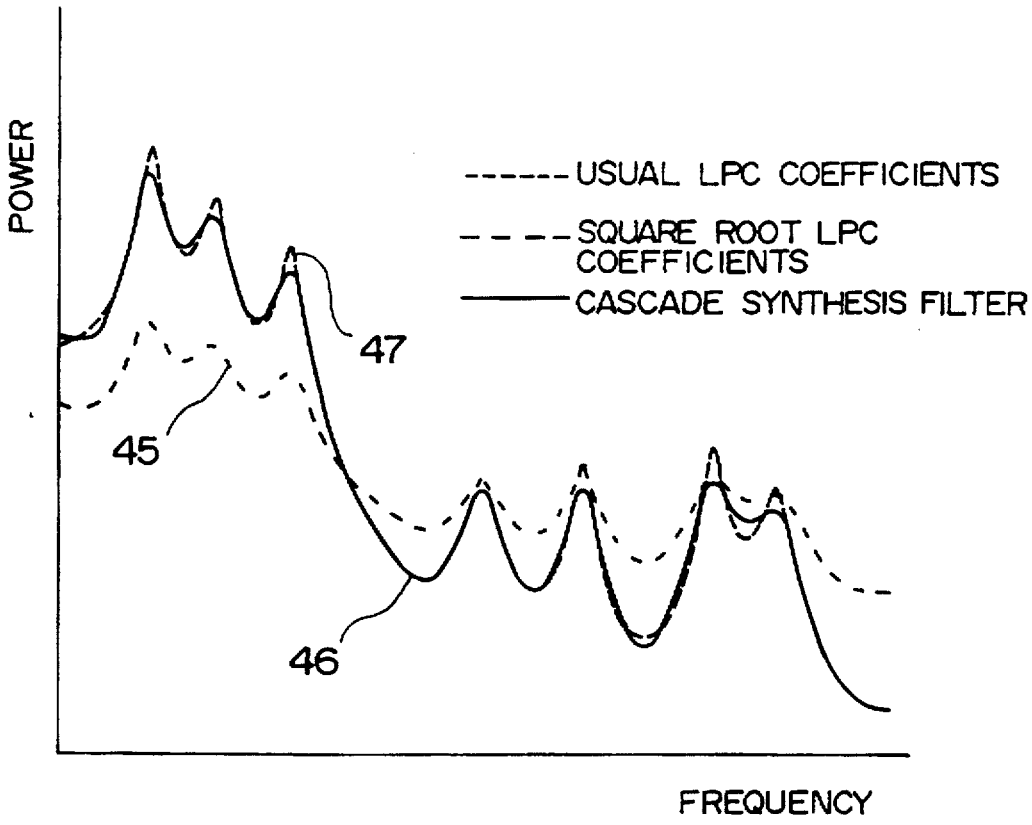
FIG. 12 is a graph showing examples of power spectral envelopes of various filter outputs.

With such an arrangement, the LPC spectrum of the output from one filter 14*a* is such as indicated by the curve 45 in FIG. 12 and the combined LPC spectrum of the outputs from the two filters 14*a* is such as indicated by the curve 46 in FIG. 12, whereas the LPC spectrum of the output from a conventional single-stage filter is such as indicated by the curve 47. As will be seen from FIG. 12, the two-stage filter that embodies the present invention provides about the same characteristic as does the conventional single-stage filter of which high computational precision is required. Additionally, according to the present invention, the 20th-order filter 14*a* needs only to be designed for the implementation of the two-stage filter; and since the spectral peaks of the filter characteristic are not sharp, the computational precision required for the filter coefficients through transformation of the LSP into the LPC coefficients is significantly relieved as compared with the computational precision needed in the past, and hence the synthesis filter can be applied even to a fixed-point digital signal processor (DSP).

As described above, according to the present invention, the LPC coefficients, after being transformed into the LPC cepstrum coefficients, are modified in accordance with the masking function and the enhancement function, and the modified LPC cepstrum coefficients are inversely transformed into the LPC coefficients through the use of the method of least squares. Thus the LPC coefficients of an order lower than that of the LPC cepstrum coefficients can be obtained as being reflective of the modification in the LPC cepstrum domain with high precision of approximation.

Figure 1:
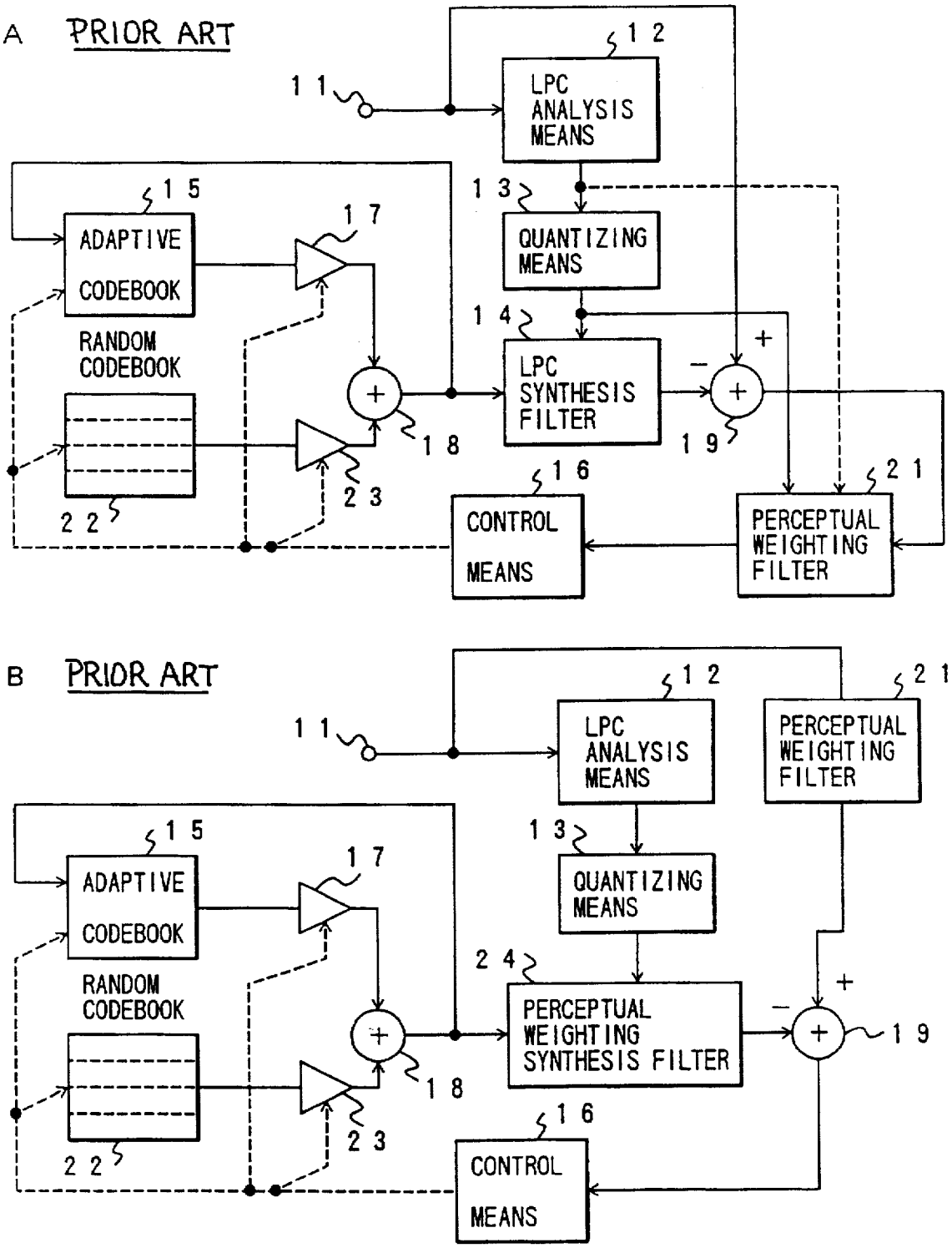
FIGS. 1A and B are block diagrams showing prior art CELP coding schemes.

For example, when the order p of LPC coefficients modified corresponding to the masking function is the same as the order prior to the modification, the computational complexity for the perceptual weighting filter in FIG. 1 is reduced to ⅓ that involved in the case of using Eq. (4). In the aforementioned prior art example the multiplication needs to be done about 2,460,000 times, but according to the present invention, approximately 820,000 times. On the other hand, the computation for the transformation into the LPC cepstrum coefficients and for the inverse transformation therefrom, for example, the computation of Eq. (12), is conducted by solving an inverse matrix of a 20 by 20 square matrix, and the number of computations involved is merely on the order of thousands of times. In the CELP coding scheme, since the computational complexity in the perceptual weighting synthesis filter accounts for 40 to 50% of the overall computational complexity, the use of the present invention produces a particularly significant effect of reducing the computational complexity.

Moreover, according to the present invention, since the modification is carried out in the LPC cepstrum domain, each order (each element) of the LPC cepstrum coefficients can be modified individually, and consequently, they can be modified with far more freedom than in the past and with high precision of approximation to desired characteristic. Accordingly, the modified LPC coefficients well reflect the target characteristic and they are inversely transformed into LPC coefficients of a relatively low order—this allows ease in, for instance, determining the filter coefficient and does not increase the order of the filter.

It will be apparent that many modifications and variations may be effected without departing from the scope of the novel concepts of the present invention.

What is claimed is:

1. An LPC coefficient modifying method which transforms p-order LPC coefficients of an acoustic signal into n-order (where n>p) LPC cepstrum coefficients, then modifies said LPC cepstrum coefficients, and inversely transforms said modified LPC cepstrum coefficients into m-order (where m<n) LPC coefficients for use in controlling the characteristics of a filter, characterized in:

that said transformation of said modified LPC cepstrum coefficients into said m-order LPC coefficients is performed by using the method of least squares in an LPC cepstrum domain.

2. The method of claim 1, characterized in:

that said modification of said LPC cepstrum coefficients is to multiply each order (each element) of them by 0.5.

3. The method of claim 2, characterized in:

that said p-order LPC coefficients are to determine filter coefficients of a synthesis filter; and that said inversely transformed LPC coefficients are used to determine filter coefficients of two cascaded filter sections of the same characteristic for use as said synthesis filter.

4. An LPC coefficient modifying method which is used in a coding scheme that obtains a spectral envelope of an input acoustic signal by an LPC analysis and determines coded data of said input acoustic signal in a manner to minimize a difference signal between said input signal and an LPC synthesized signal of said coded data and which modifies LPC coefficients for use as filter coefficients of an all-pole or moving average digital filter that weights said difference signal according to human perceptual or psycho-acoustic characteristics, said method comprising the steps of:

transforming p-order LPC coefficients, obtained by said LPC analysis of said input acoustic signal, into n-order (where n>p) LPC cepstrum coefficients;

modifying said n-order LPC cepstrum coefficients into n-order modified LPC cepstrum coefficients; and inversely transforming said n-order modified LPC cepstrum coefficients, by the method of least squares, into new m-order (where m<n) LPC coefficients to obtain LPC coefficients for use as said filter coefficients.

5. An LPC coefficient modifying method which is used in a coding scheme that obtains a spectral envelope of an input acoustic signal by an LPC analysis and determines coded data of said input acoustic signal in a manner to minimize a difference signal between said input signal and an LPC synthesized signal of said coded indexes and which modifies LPC coefficients for use as filter coefficients of a digital filter that performs an LPC synthesis of said synthesized signal and weights said difference signal according to human perceptual or psycho-acoustic characteristics, said method comprising the steps of:

quantizing p-order LPC coefficients, obtained by said LPC analysis of said input acoustic signal, into quantized LPC coefficients;

transforming both of said LPC coefficients and quantized LPC coefficients into n-order LPC cepstrum coefficients, respectively;

modifying said n-order LPC cepstrum coefficients, transformed from said LPC coefficients, into n-order modified LPC cepstrum coefficients;

adding said n-order LPC cepstrum coefficients, transformed from said quantized LPC coefficients, and said modified LPC cepstrum coefficients into n-order added LPC cepstrum coefficient; and inversely transforming said n-order added LPC cepstrum coefficients by the method of least squares into new m-order (where m<n) LPC coefficients to obtain LPC coefficients for use as said filter coefficients.

6. The method of claim 4 or 5, characterized in:

that said modifying step is a step of calculating the relationship between said input acoustic signal and a masking function, which corresponds thereto and is based on human perceptual or psycho-acoustic characteristics, in the domain of said n-order LPC cepstrum coefficients and modifying said n-order LPC cepstrum coefficients on the basis of said relationship.

7. The method of claim 6, characterized in:

that said modifying step is a step of modifying said LPC cepstrum coefficients $c_j$ (where j=1, 2, . . . , n) by multiplying them by a constant $\beta_j$ based on said relationship.

8. The method of claim 7, characterized in:

said modifying step is a step of determining q (where q is an integer equal to or greater than 2) positive constants $\gamma_k$ (where k=1, . . . , q) equal to or smaller than 1 on the basis of said relationship, then multiplying said n-order LPC cepstrum coefficients $c_j$ (where j=1, 2, . . . , n) by $\gamma_k^j$ to obtain q LPC cepstrum coefficients, and adding or subtracting said q LPC cepstrum coefficients on the basis of said relationship.

9. The method of claim 4 or 5, characterized in:

that said m is a value nearly equal to said p.

10. A method which modifies LPC coefficients for use as filter coefficients of an all-pole or moving average digital filter that processes a decoded synthesized signal of coded input data of an acoustic signal to suppress quantization noise, said method comprising the steps of:

transforming p-order LPC coefficients, derived from said input indexes, into n-order (where n>p) LPC cepstrum coefficients;

modifying said n-order LPC cepstrum coefficients into n-order modified LPC cepstrum coefficients; and inversely transforming said n-order LPC cepstrum coefficients, by the method of least squares, into new m-order (where m<n) LPC coefficients to obtain said LPC coefficients for use as said filter coefficients.

11. A method which modifies LPC coefficients for use as filter coefficients of a digital filter that uses p-order LPC coefficients in coded input data of an acoustic signal to simultaneously synthesize a signal and perceptually suppress quantization noise, said method comprising the steps of:

transforming said p-order LPC coefficients into n-order (where n>p) LPC cepstrum coefficients;

modifying said n-order LPC cepstrum coefficients into n-order modified LPC cepstrum coefficients;

adding said n-order LPC cepstrum coefficients and said n-order modified LPC cepstrum coefficients; and transforming said added LPC cepstrum coefficients, by the method of least squares, into new m-order (where m<n) LPC coefficients to obtain said LPC coefficients for use as said filter coefficients.

12. The method of claim 10 or 11, characterized in:

that said modifying step is a step of calculating the relationship between a decoded synthesized signal of said input data and an enhancement characteristic function, which corresponds thereto and is based on human perceptual or psycho-acoustic characteristics, in the domain of said n-order LPC cepstrum coefficients and modifying said n-order LPC cepstrum coefficients on the basis of said relationship.

13. The method of claim 12, characterized in:

that said modifying step is a step of modifying said LPC cepstrum coefficients $c_j$ (where j=1, 2, . . . , n) by multiplying them by a constant $\beta_j$ based on said relationship.

14. The method of claim 12, characterized in:

that said modifying step is a step of determining q (where q is an integer equal to or greater than 2) positive constants $\gamma_k$ (where k=1, . . . , q) equal to or smaller than 1 on the basis of said relationship, then multiplying said n-order LPC cepstrum coefficients $c_j$ (where j=1, 2, . . . , n) by $\gamma_k^j$ to obtain q LPC cepstrum coefficients, and adding or subtracting said q LPC cepstrum coefficients on the basis of said relationship.

15. The method of claim 12, characterized in:

that said m is a value nearly equal to said p.

* * * * *